US006065554A

United States Patent [19]

Taylor et al.

[11] Patent Number: 6,065,554

[45] Date of Patent: May 23, 2000

[54] PREFORM CUTTING ELEMENTS FOR ROTARY DRILL BITS

[75] Inventors: Malcolm Roy Taylor, Gloucester; Nigel Dennis Griffin, Whitminster; Tom Scott Roberts, Gloucester, all of United Kingdom

[73] Assignee: Camco Drilling Group Limited, Stonehouse, United Kingdom

[21] Appl. No.: 08/949,224

[22] Filed: Oct. 10, 1997

[30] Foreign Application Priority Data

Oct. 10, 1997 [GB] United Kingdom ..... 9621217

[51] Int. Cl.[7] ..... E21B 10/46

[52] U.S. Cl. ..... 175/430; 175/431

[58] Field of Search ..... 175/428, 430, 175/431, 434

[56] References Cited

U.S. PATENT DOCUMENTS

| | | | |
|---|---|---|---|
| 4,570,726 | 2/1986 | Hall . | |
| 4,852,671 | 8/1989 | Southland . | |
| 4,872,520 | 10/1989 | Nelson . | |
| 4,911,254 | 3/1990 | Keith | 175/430 |
| 4,984,642 | 1/1991 | Renard et al. . | |
| 5,025,874 | 6/1991 | Barr et al. | 175/430 |
| 5,115,873 | 5/1992 | Pastusek | 175/65 |
| 5,172,778 | 12/1992 | Tibbitts et al. . | |
| 5,314,033 | 5/1994 | Tibbitts | 175/431 |
| 5,332,051 | 7/1994 | Knowlton | 175/430 |
| 5,377,773 | 1/1995 | Tibbitts . | |
| 5,460,233 | 10/1995 | Meany et al. | 175/428 |
| 5,533,582 | 7/1996 | Tibbitts | 175/430 |
| 5,740,874 | 4/1998 | Matthias | 175/430 |
| 5,778,995 | 7/1998 | McCarian | 175/420 |

FOREIGN PATENT DOCUMENTS

| | | |
|---|---|---|
| 0186408 | 7/1986 | European Pat. Off. . |
| 0358526 | 3/1990 | European Pat. Off. . |
| 0572761 | 12/1993 | European Pat. Off. . |
| 2175939 | 12/1986 | United Kingdom . |
| 2294069 | 4/1996 | United Kingdom . |
| 9415058 | 7/1994 | WIPO . |

*Primary Examiner*—Frank S. Tsay
*Attorney, Agent, or Firm*—Jeffery E. Daly

[57] ABSTRACT

A preform cutting element for a rotary drag-type drill bit comprises a front facing table of superhard material having a front surface, a peripheral surface, a rear surface bonded to a substrate of less hard material, and a cutting edge formed by at least part of the junction between the front surface and the peripheral surface. The front surface of the facing table is formed with a chip-breaking formation which is located adjacent the cutting edge and is shaped to deflect transversely of the front surface of the facing table cuttings which, in use, are removed by the cutting edge from the formation being drilled. The chip-breaking formation may comprise a peripheral groove or rebate, or an upstanding ridge or insert.

39 Claims, 4 Drawing Sheets

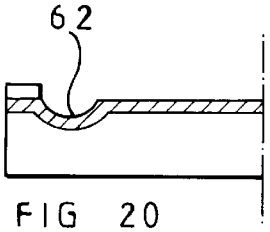
FIG 20
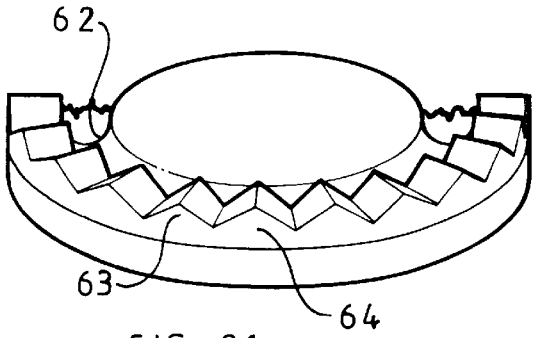
FIG 21
FIG 22
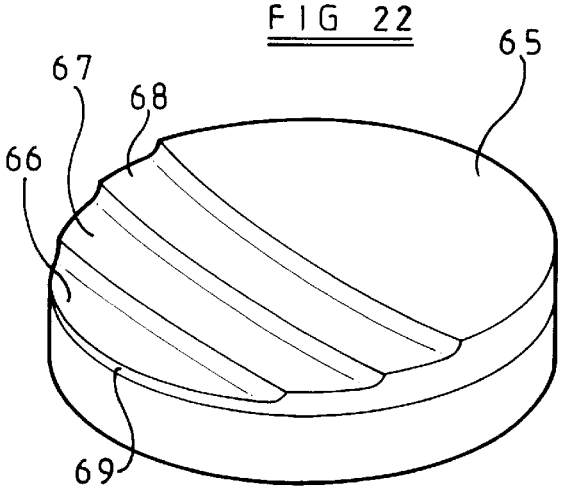
FIG 23
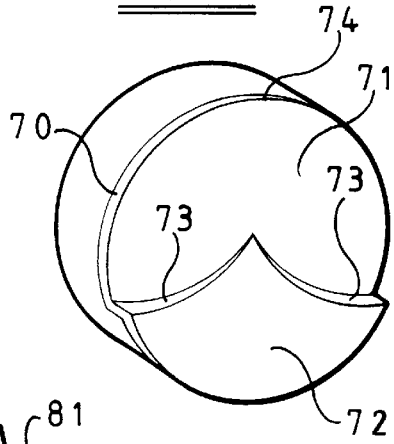
FIG 24
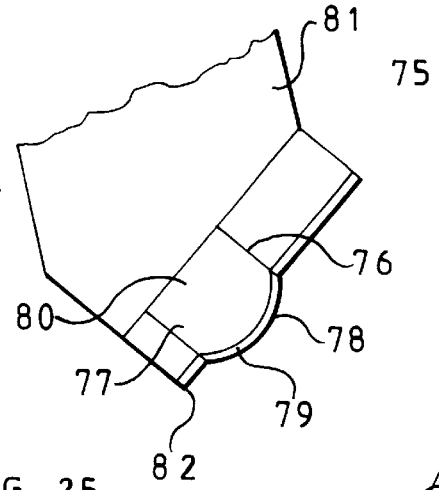
FIG 25
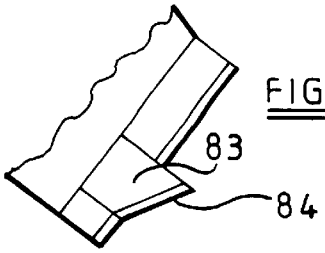
FIG 26
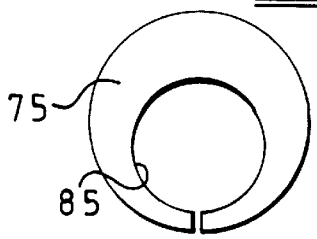

PREFORM CUTTING ELEMENTS FOR ROTARY DRILL BITS

BACKGROUND OF THE INVENTION

1. Field of Invention

The invention relates to preform cutting elements for rotary drag-type drill bits, for use in drilling or coring holes in subsurface formations, and of the kind comprising a bit body having a shank for connection to a drill string, a plurality of cutting elements mounted at the surface of the bit body, and a passage in the bit body for supplying drilling fluid to the surface of the bit body for cooling and/or cleaning the cutters. Each cutting element comprises a front facing table of superhard material bonded to a less hard substrate.

2. Description of Related Art

The cutting element may be mounted on a carrier, also of a material which is less hard than the superhard material, which is mounted on the body of the drill bit, for example, is secured within a socket on the bit body. Alternatively, the cutting element may be mounted directly on the bit body, for example the substrate may be of sufficient axial length that it may itself be secured within a socket on the bit body.

In drag-type drill bits of this kind the bit body may be machined from metal, usually steel, and sockets to receive the carriers or the cutting elements themselves are machined in the bit body. Alternatively, the bit body may be moulded from tungsten carbide matrix material using a powder metallurgy process. Drag-type drill bits of this kind are particularly suitable for drilling softer formations. However, when drilling soft, sticky shale formations in a water based mud environment, and in other similar conditions, there may be a tendency for the shavings or chips of formation gouged from the surface of the borehole not to separate from the surface and to be held down on the surface of the formation by the subsequent passage over the shaving or chip of other cutters and parts of the drill bit. Also, there may be a tendency for such material to adhere to the surface of the bit body, a phenomenon known as "bit balling", eventually resulting in the bit becoming ineffective for further drilling.

In order to alleviate or overcome this problem, the facing table may be formed with a chip breaker which serves to break the shaving or chip of formation into fragments as it passes over the front surface of the cutting element, thus enabling the particles to be entrained in the flow of drilling fluid, and swept away from the cutting element, so that they are not held down on the formation or do not adhere to the bit.

The present invention sets out to provide improved forms of chip breakers for preform cutting elements for rotary drag-type drill bits.

SUMMARY OF THE INVENTION

According to the invention there is provided a preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the front surface of the facing table being formed with a formation which is located adjacent at least a part of the cutting edge and is shaped to deflect transversely of the front surface of the facing table cuttings which, in use, are removed by the cutting edge from the formation being drilled. The cutting element may be circular or part-circular in shape and said formation may extend around part or all of an outer marginal portion of the front surface of the facing table.

In one embodiment of the invention said formation may comprise a groove formed in said front surface of the facing table adjacent the cutting edge. The groove may have an outer edge which is spaced inwardly from the cutting edge. The outer edge of the groove is preferably spaced a substantially constant distance from the cutting edge. The groove may be smoothly and concavely curved in cross-section. For example, it may be part-circular in cross-section. Alternatively, the groove may be V-shaped in cross-section, or of any other cross-sectional shape.

There may be formed in the groove a plurality of protrusions spaced apart longitudinally of the groove. Each protrusion may have an upper surface which lies at substantially the same level as the front surface of the facing table. Each protrusion may extend transversely across the groove, for example across substantially the full width of the groove. Each protrusion may be elongate and inclined at an angle of 90°, or less than 90°, to the length of the groove All the protrusions may be inclined at substantially the same angle to the length of the groove, or adjacent protrusions may be inclined at opposite and equal angles to the length of the groove. Each protrusion may be straight or curved as it extends across the groove. In an alternative arrangement, each protrusion is generally circular in cross-section. A portion of the front surface of the facing table between the groove and the cutting edge may be configured to upstand from that surface. For example, said portion of the surface may be formed with upstanding serrations. Said serrations may fill the space between the outer edge of the groove and the cutting edge, the cutting edge then being defined by parts of said serrations.

In another embodiment of the invention, said formation may comprise a peripheral rebate at the junction between the front surface and the peripheral surface of the front facing table, the cutting edge being defined by the junction between the rebate and the peripheral surface. The rebate may be smoothly and concavely curved, angular, or stepped in cross-section.

There may be formed in the rebate a plurality of protrusions spaced apart longitudinally of the rebate. Each protrusion may have an upper surface which lies at substantially the same level as the front surface of the facing table. Each protrusion may extend transversely across the rebate, and may extend substantially the full width of the rebate. Each protrusion may be elongate and inclined at an angle of 90°, or less than 90°, to the length of rebate. Each protrusion may be straight or curved as it extends across the rebate.

In the case where the rebate is stepped in cross-section, there may be provided at least two steps between the front surface of the facing table and the cutting edge. Each step may be substantially equally spaced from the cutting edge along substantially the whole length of the step. Alternatively, in the case where the cutting edge of the facing table is convexly curved, each step may be curved at a larger radius than the cutting edge so that each end of the step intercepts the cutting edge. Each step may be substantially straight.

In any of the above arrangements the rebate may include a bottom wall extending away from the cutting edge and a side wall upstanding from the bottom wall and extending towards the front surface of the facing table, said side wall including at least two portions on each side of an apex directed towards the cutting edge whereby, in use, chips removed by the cutting edge and passing across the rebate are deflected to both sides of the apex.

In a further embodiment of the invention the formation on the front surface of the facing table may comprise at least one protrusion which upstands from said front surface. The protrusion may comprise a ridge formed on said front surface adjacent the cutting edge. The ridge may have an outer edge which is spaced inwardly from the cutting edge. The outer edge of the groove is preferably spaced a substantially constant distance from the cutting edge. The ridge may, for example be rectangular or curved in cross-section.

In a further embodiment of the invention the formation on the front surface of the facing table may comprise a recess which extends across a major part of the front surface and has an outer edge which is spaced inwardly from the cutting edge. Preferably the outer edge of the recess is spaced a constant distance from the cutting edge. The recess may be smoothly and concavely curved in cross-section. The recess may be concentric with the front surface of the facing table.

In any of the above embodiments said formation on the front surface of the facing table may be formed during formation of the superhard facing table in a high pressure, high temperature press. Alternatively, the formation may be formed on the facing table by a shaping operation carried out subsequent to formation of the superhard facing table. In a still further embodiment of the invention, the formation on the front surface of the facing table may be provided by an insert which is received in a socket in the cutting element adjacent the cutting edge thereof, the insert including a part which is upstanding from the front surface of the facing table. The insert and socket may be substantially circular in cross-section. At least the part of the insert which is received in the socket may be cylindrical. The socket and insert may extend through substantially the whole thickness of the cutting element. The upstanding part of the insert may be domed, and the outer periphery of the dome preferably lies at the same level as the front surface of the facing table.

Alternatively, the upstanding part of the insert may have a front surface which is inclined away from the front surface of the facing table as it extends away from the cutting edge. The edge of said inclined surface nearest the cutting edge of the facing table preferably lies at the same level as the front surface of the facing table. The insert may comprise a front layer of superhard material bonded to a substrate of less hard material, the superhard material forming the front surface of the upstanding part of the insert.

BRIEF DESCRIPTION OF THE DRAWINGS

FIG. 20 is a part-section through a further cutting element incorporating a chip breaker.

FIG. 21 is a diagrammatic part perspective view of the cutter of FIG. 20.

FIGS. 22 and 23 are perspective views of still further forms of cutting element.

FIGS. 24 and 25 are diagrammatic sectional views through still further forms of cutting element.

FIG. 26 is a plan view of a component used in the manufacture of the cutting elements of FIGS. 24 and 25.

DETAILED DESCRIPTION OF THE PREFERRED EMBODIMENTS

Figure 1:
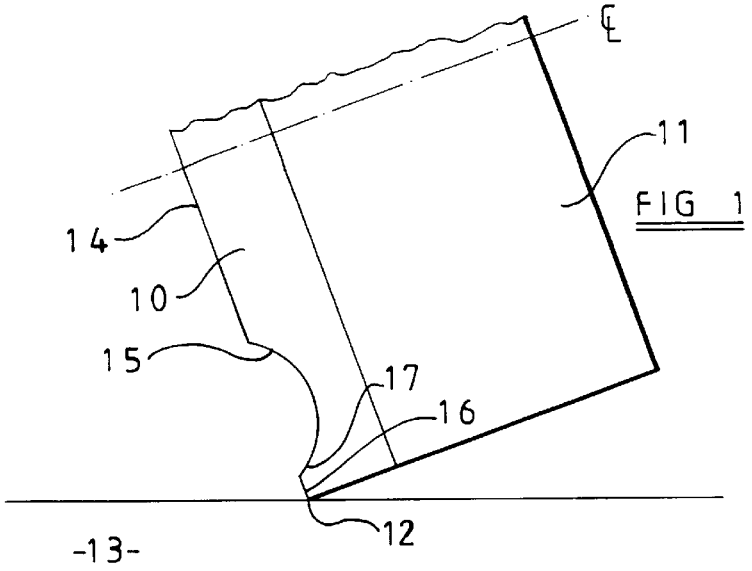
FIGS. 1–8 are diagrammatic sectional views through various forms of preform cutting element in accordance with the invention.

FIG. 1 shows in cross-section part of a circular preform cutting element for a rotary drag-type drill bit. The cutting element comprises a front facing table 10 of polycrystalline diamond bonded, in a high pressure, high temperature press, to a substrate 11 of less hard material, such as cemented tungsten carbide. The manner of manufacture of preform cutting elements of this general kind are well known and will not therefore be described in detail.

As is also well known, the cutting element may be mounted on a bit body by the substrate 11 being directly received and secured within a socket in the bit body. The element may be secured, for example, by brazing or by shrink fitting. Alternatively, the substrate 11 may be brazed to a carrier, which may be in the form of a part-cylindrical stud or post, which is then in turn brazed or shrink-fitted in an appropriately shaped socket in the bit body. An exposed part of the periphery of the facing table 10 forms a cutting edge 12 which engages the formation 13 during drilling.

Polycrystalline diamond cutting elements of this kind are generally set on the drill bit so that the front cutting face 14 of the cutting element is at 15°–20° negative back rake. That is to say the front surface 14 leans forwards in the direction of movement of the cutter as it acts on the formation. While this is suitable for the majority of formations, it may be advantageous for the front face of the cutting element to be inclined at a positive rake angle since this may cause the soft formation to shear more easily. FIG. 1 shows an arrangement where this may be achieved automatically without the necessity of changing the drill bit. For this purpose the front face 14 of the diamond facing table 10 is formed with a concave chip breaker groove 15 which extends around or across part of the marginal portion of the facing table adjacent the cutting edge 12 and spaced inwardly a short distance from the cutting edge.

When cutting harder formations the cutting edge penetrates only a short distance into the formation and the active portion of the front face 14 is therefore the small portion 16 between the cutting edge 12 and the chip breaker groove 15 which, as shown, is arranged at a negative back rake angle of 15°–20°. However, if a softer formation is encountered the cutting edge 12 will penetrate more deeply into the formation with the result that a proportion of the depth of the formation will bear against that part 17 of the groove 15 which is nearest to the cutting edge and which is arranged at a positive rake angle of 15°–30°. This provides the more aggressive shearing action appropriate for a softer formation.

At the same time, of course, the part of the groove 15 which is further from the cutting edge 12 serves as a chip breaker, causing break up of shavings or chips cut from the formation as they pass upwardly over the front of the cutting element. The broken up chips are then more easily dispersed in the drilling fluid which will normally be flowing under pressure over the cutting element as drilling progresses, and will thus be prevented from adhering to the drill bit or being held down against the formation.

In the arrangement of FIG. 1 the facing table 10 is thicker than the maximum depth of the groove 15. In the alternative arrangement in FIG. 2 the substrate 18 has a shaped surface 19 to which the diamond facing table 20 is applied and the chip breaker groove 21 in the facing table corresponds to a similar groove 22 in the face 19 of the substrate, so that the facing table 20 is of substantially constant thickness.

Figure 3:
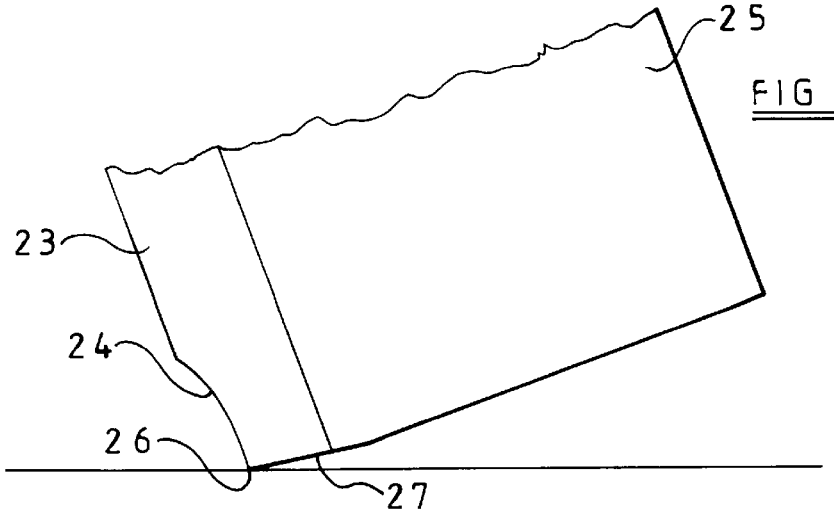

In the arrangement of FIG. 3 the polycrystalline diamond facing table 23 is formed with a cylindrical chip breaker groove 24 so that, as a shaving or chip is lifted from the formation by the cutting element it passes upwardly across the front face of the groove 24 and the curved surface tends to cause it to break into fragments. The particles can be readily washed away by the drilling fluid. In this arrangement, however, the part of the facing table 23 and substrate 25 to the rear of the cutting edge 26 are chamfered as indicated at 27, for example is conically chamfered, to provide a shallow relief angle to reduce the frictional engagement between the cutting element and the formation behind the cutting edge 26.

Figure 4:
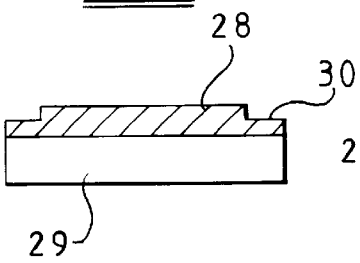
Figure 5:
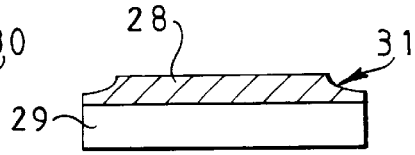
Figure 6:
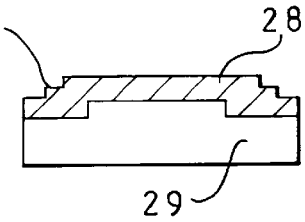
Figure 7:
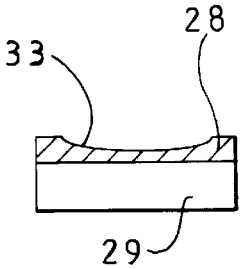
Figure 8:
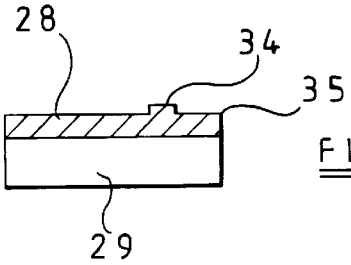

FIGS. 4–8 show other configurations of the facing table 28, bonded to a tungsten carbide substrate 29 to form a chip breaker. In the arrangement of FIG. 4 the chip breaker is a rectangular section peripheral groove or rebate 30. In FIG. 5 it is a concave peripheral rebate 31. In FIG. 6 the chip breaker groove has a stepped section as indicated at 32. FIG. 7 shows an arrangement where the chip breaker is in the form of a central saucer-shaped recess 33 in the front face of the facing table. FIG. 8 shows an arrangement where a chip breaker comprises an upstanding bar 34 on the front face of the facing table 28. The bar 34 may be straight or may be curved so as to be generally parallel to the curved cutting edge 35 of the cutting element. The bar 34 may be formed by grinding the front surface of the facing table 28 or it may be sinter moulded on the front face of the facing table during manufacture.

In the arrangements of FIGS. 4–8, and indeed in any chip breaker formation on a polycrystalline diamond cutting element, chemical vapour deposition (CVD) technology may be used to apply, for example, a TiN coating to the front surface of the facing table, including the chip breaker formation, to reduce friction and chemical affinity, so as to further reduce any tendency for chips of formation to adhere to the cutting element.

Figure 9:
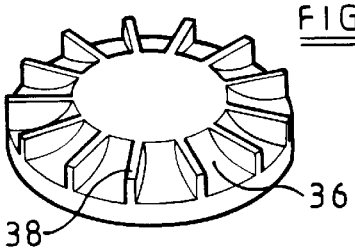
FIG. 9 is a diagrammatic perspective view of an alternative form of element.
Figure 10:
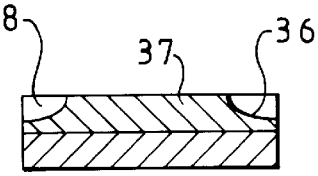
FIG. 10 is a cross section through the cutting element of FIG. 9.

In all of the arrangements described above the chip breaker formation has been in the form of a continuous groove or rebate. FIGS. 9 and 10 show a further arrangement, in accordance with the invention, where a peripheral chip breaker groove 36 on the facing table 37 of a cutting element is formed with a plurality of equally spaced radial ridges 38 extending across the groove 36. These ridges modify the shape and direction of the chip of formation as it passes across the chip breaker groove and aids bit cleaning.

Figure 11:
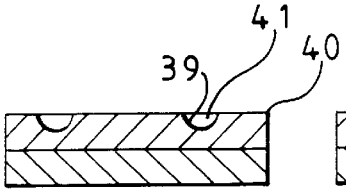
FIGS. 11 to 13 are similar sectional views of further forms of cutting element.
Figure 13:
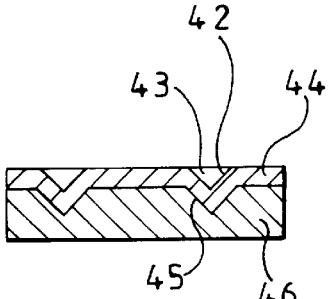

FIG. 11 shows an alternative arrangement where the chip breaker groove 39 is spaced radially inwardly from the cutting edge 40 of the facing table. In this case also radially extending ridges 41 are spaced apart around the annular groove 39. FIG. 13 shows a further arrangement in which the chip breaker groove 42 is V-shaped in cross section and is formed with radial spaced ridges 43. In this case the facing table 44 is of substantially constant thickness, the chip breaker groove 42 in the facing table lying opposite a similar V-shaped groove 45 formed in the surface of the substrate 46.

Figure 12:
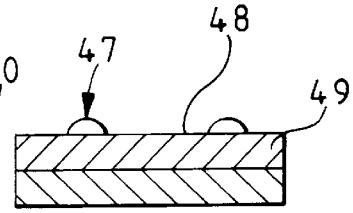

In the arrangement of FIG. 12 the chip breaker comprises a circle of bumpy protrusions 47 on the front face 48 of the facing table 49, the protrusions being spaced inwardly from the peripheral cutting edge of the facing table. As in the arrangement of FIG. 8, the protrusions may be formed by grinding the facing table or by forming the protrusions by sintering when the cutting element is manufactured.

Figure 14:
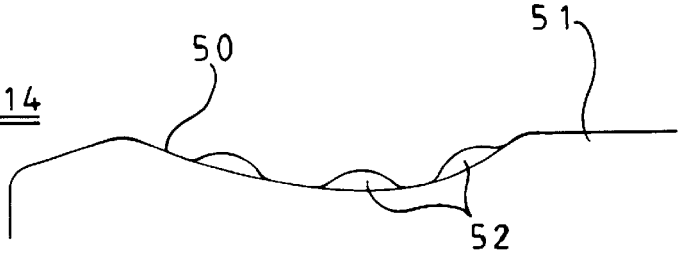
FIG. 14 is a diagrammatic section, on an enlarged scale, through a chip breaker groove, cutting element.

In any of the arrangements of FIGS. 4–13, the chip break grooves may also be formed by plunge EDM. FIG. 14 shows on an enlarged scale a concave chip breaker groove 50 in the facing table 51 of a cutting element where protrusions or bumps 52 are formed over the surface of the groove 50 to reduce friction between the chip and the groove as it passes over the surface of the groove.

Figure 15:
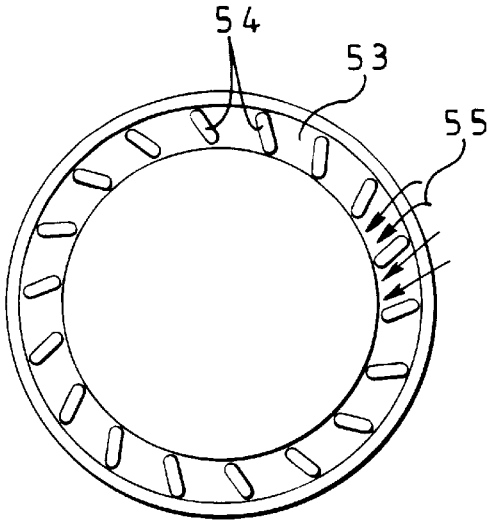
FIGS. 15 to 19 are plan views of cutting elements incorporating chip breakers.
Figure 16:
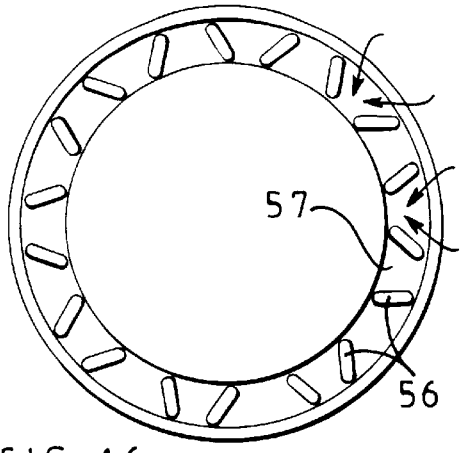

In the arrangements of FIGS. 9–13, the ridges in the chip breaker groove are described as being radial. FIGS. 15–19 are plan views of other forms of cutting element where the ridges are of different shapes and orientations so as to control the passage of chips of formation as they pass over the groove from the cutting edge. In the arrangement of FIG. 15 the annular chip breaker groove 53 is formed with spaced transverse ridges 54 which are inclined at an angle to a radius of the cutting element which passes through each ridge. The angled ridges cause deviation of the chips of formation in a peripheral direction as the chips pass across the face of the cutting element, as indicated by the arrows 55. This further breaks up the chippings. The breaking up of the chippings is also enhanced by the arrangement of FIG. 16 where alternate ridges 56 in the annular chip breaker groove 57 are inclined in opposite directions.

Figure 17:
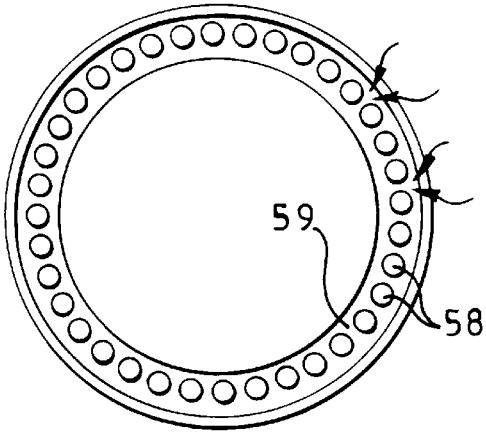

FIG. 17 shows a construction where chippings of formation are further broken up, and friction is reduced, by domed protrusions 58 spaced apart around the chip breaker groove 59.

Figure 18:
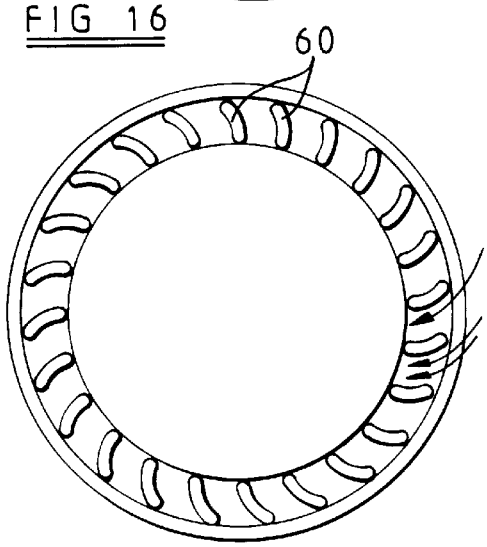
Figure 19:
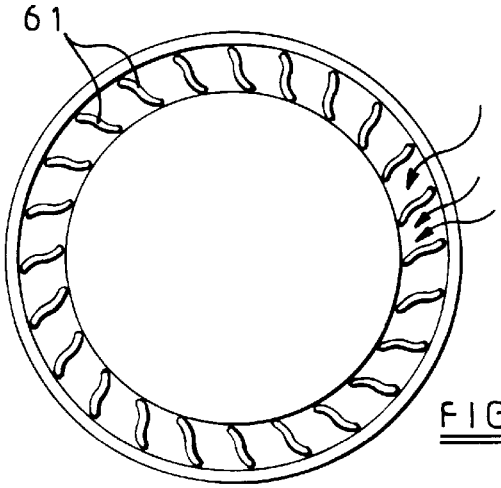

The arrangement of FIG. 18 is somewhat similar to that of FIG. 15, but in this case the transverse ridges 60 are curved as well as being angled as they extend inwardly from the cutting edge of the element. FIG. 19 shows a further modified arrangement in which the ridges 61 have a double curvature. In the arrangements of FIGS. 15, 16, 18 and 19 the angled protrusions in the chip-breaking groove can serve to control the direction taken by the cuttings as they are broken from the formation. Protrusions of the kind shown in FIGS. 15–19 may also be provided in the rebate 36 in the arrangement of FIGS. 9 and 10. Similarly the radial protrusions 38 in FIGS. 9 and 10 may be used in the grooves of arrangements, similar to FIGS. 15–19, where the groove is spaced inwardly from the cutting edge.

Figure 2:
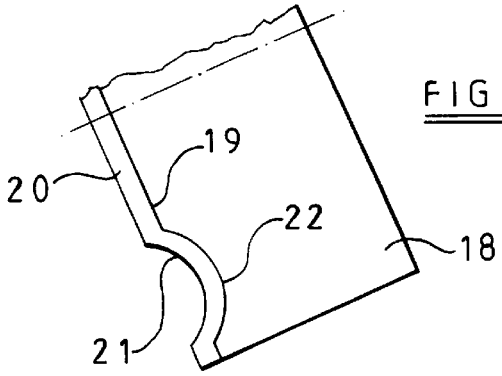

FIGS. 20 and 21 show a further chip breaker arrangement where the basic chip breaker groove 62, similar to the groove in the FIG. 2 arrangement, is supplemented by a toothed or serrated lip 63 outwardly of the peripheral groove 62 and forming a serrated cutting edge for the facing table 64 of the cutting element. In all of the above arrangements where there is provided a single chip breaker groove adjacent the cutting edge of the cutting element, the chip breaker will only be fully effective when the cutting element is new and will increasingly lose its effectiveness as a wear flat forms on the cutting element.

FIG. 22 shows an arrangement where the front face 65 of the facing table of the cutting element is formed with a stepped rebate 66, 67 and 68 extending away from the cutting edge 69. When the cutting element is new the outermost step 66 performs the bulk of the chip breaking function, but as the element wears, and the portion carrying the step 66 wears away, the next inner step 67 takes over the chip breaking function., and so on. Preferably the steps are slightly curved, as shown, to match the profile of the adjacent formation formed by a number of similar cutting elements side-by-side and overlapping. The multi-stepped arrangement of FIG. 22 is also particularly advantageous for use in interbedded formations, since the steps can break up cuttings over a wide range of penetration rates.

In the construction of FIG. 23, the polycrystalline diamond facing table 70 of the cutting element is formed with a two-lobed rebate 71 to provide an upstanding land 72 on the surface which is generally in the shape of a snow plough. The curved edges 73 of the land are so located and shaped that a chipping of formation cut by the cutting edge 74 passes across the rebate 71 and is split and diverted in two opposing directions by the land 72, and is thus broken up and prevented from adhering to the cutting element. In FIG. 24 a preform cutting element 75 is formed with a through-hole 76 of circular or other cross sectional shape in which is brazed an insert 77 having a domed outer surface 78. The insert 77 is of the same general construction as the main part of the cutting element, comprising a polycrystalline diamond facing table 79 bonded to a tungsten carbide substrate portion 80. Alternatively, the insert 77 may be formed from plain tungsten carbide alone. The combination cutting element is shown brazed to a carrier 81. The insert 80, which is nearer the cutting edge 82 serves as a chip breaker and also serves to increase the negative back rake of the cutting element with wear, which may be advantageous with some types of formation.

FIG. 25 shows a similar arrangement, but in this case the insert 83 has a flat planar surface 84 to increase the back rake with wear. FIG. 26 is a front view of the basic preform cutting element formed with a circular aperture 85 ready to receive the inserts 77 or 83. The cutting element and insert may each be of any appropriate diameter. For example, the cutting element may be of 19 mm diameter and the insert of 8 mm or 13 mm diameter, or the cutting element may be of 13 mm diameter and the insert of 8 mm diameter. The insert 77 or 83 may be brazed into the aperture 85 after the main part of the element has been bonded to the carrier 81.

The element shown in FIG. 26 may also be used as a low cost cutter for a rotary drill bit by simply filling the aperture 85 with a cylindrical plug of tungsten carbide which may be brazed into place at the same time as the cutter 75 is brazed into the bit body. Such a cutter would, in use, achieve 39% wear before the wear flat reaches the carbide plug, rendering the cutter ineffective.

In any of the cutting elements according to the invention, the interface between the facing table and substrate may be non-planar and configured, instead of being substantially flat, so as to improve the bond between the facing table and substrate and also to provide other advantages, as is well known in the art. Alternatively or in addition, there may be provided between the facing table and the substrate a transition layer which may, for example, have certain characteristics, such as hardness, which are intermediate the corresponding characteristics of the facing table and substrate.

Whereas the present invention has been described in particular relation to the drawings attached hereto, it should be understood that other and further modifications, apart from those shown or suggested herein, may be made within the scope and spirit of the present invention.

What is claimed:

1. A preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the front surface of the facing table being formed with a groove which is smoothly and continuously curved in cross section and is located adjacent at least a part of the cutting edge and is shaped to deflect transversely of the front surface the facing table cuttings which, in use, are removed by the cutting edge from the formation being drilled.

2. A cutting element according to claim 1, wherein the groove has an outer edge which is spaced inwardly from the cutting edge by a substantially constant distance.

3. A cutting element according to claim 1, wherein the groove is part circular in cross-section.

4. A preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the front surface of the facing table being formed with a groove which is located adjacent at least a part of the cutting edge, and there being formed in the groove a plurality of protrusions spaced apart longitudinally of the groove.

5. A cutting element according to claim 4, wherein each protrusion has an upper surface which lies at substantially the same level as the front surface of the facing table.

6. A cutting element according to claim 4, wherein each protrusion extends transversely across the groove.

7. A cutting element according to claim 6, wherein each protrusion extends across substantially the full width of the groove.

8. A cutting element according to claim 4, wherein each protrusion is elongate and inclined at an angle of 90° to the length of the groove.

9. A cutting element according to claim 4, wherein each protrusion is elongate and inclined at an angle of less than 90° to the length of the groove.

10. A cutting element according to claim 9, wherein all the protrusions are inclined at substantially the same angle to the length of the groove.

11. A cutting element according to claim 9, wherein adjacent protrusions are inclined at opposite and equal angles to the length of the groove.

12. A preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the front surface of the facing table being formed with a groove which is located adjacent at least a part of the cutting edge, a portion of the front surface of the facing table between the groove and the cutting edge being configured to upstand from that surface.

13. A cutting element according to claim 12, wherein said portion of the surface is formed with upstanding serrations which fill the space between the outer edge of the groove and the cutting edge, the cutting edge then being defined by parts of said serrations.

14. A preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the front surface of the facing table being formed with a peripheral rebate at the junction between the front surface and the peripheral surface of the front facing table, the cutting edge being defined by the junction between the rebate and the peripheral surface.

15. A cutting element according to claim 14, wherein the rebate is smoothly and continuously curved in cross-section.

16. A cutting element according to claim 14, wherein the rebate is angular in cross-section.

17. A cutting element according to claim 14, wherein there is formed in the rebate a plurality of protrusions spaced apart longitudinally of the rebate.

18. A cutting element according to claim 17, wherein each protrusion has an upper surface which lies at substantially the same level as the front surface of the facing table.

19. A cutting element according to claim 18, wherein each protrusion extends transversely across the rebate.

20. A cutting element according to claim 19, wherein each protrusion extends across substantially the full width of the rebate.

21. A cutting element according to claim 19, wherein each protrusion is elongate and inclined at an angle of 90° to the length of the rebate.

22. A cutting element according to claim 19, wherein each protrusion is elongate and inclined at an angle of less than 90° to the length of the rebate.

23. A cutting element according to claim 22, wherein all the protrusions are inclined at substantially the same angle to the length of the rebate.

24. A cutting element according to claim 22, wherein adjacent protrusions are inclined at opposite and equal angles to the length of the rebate.

25. A preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the front surface of the facing table being formed with a peripheral rebate at the junction between the front surface and the peripheral surface of the front facing table, the cutting edge being defined by the junction between the rebate and the peripheral surface, the rebate including a bottom wall extending away from the cutting edge and a side wall upstanding from the bottom wall and extending towards the front surface of the facing table, said side wall including at least two portions on each side of an apex directed towards the cutting edge whereby, in use, chips removed by the cutting edge and passing across the rebate are deflected to both sides of the apex.

26. A preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the front surface of the facing table being formed with at least one protrusion which upstands from said front surface of the facing table.

27. A cutting element according to claim 26, wherein the protrusion comprises an elongate ridge formed on said front surface adjacent the cutting edge.

28. A cutting element according to claim 27, wherein the ridge has an outer edge which is spaced inwardly from the cutting edge.

29. A preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the front surface of the facing table being formed with a recess which is smoothly and continuously curved in cross-section and which extends across a major part of the front surface and has an outer peripheral edge which is spaced inwardly from the cutting edge.

30. A cutting element according to claim 29, wherein the recess is concentric with the front surface of the facing table and the outer edge of the recess is spaced a constant distance from the cutting edge.

31. A preform cutting element for a rotary drag-type drill bit, comprising a front facing table of superhard material having a front surface, a peripheral surface, a rear surface bonded to a substrate of less hard material, and a cutting edge formed by at least part of the junction between the front surface and the peripheral surface, the element including an insert which is received in a socket in the cutting element adjacent the cutting edge thereof, the insert including a part which is upstanding from the front surface of the facing table.

32. A cutting element according to claim 31, wherein the insert and socket are substantially circular in cross-section.

33. A cutting element according to claim 31, wherein at least the part of the insert which is received in the socket is cylindrical.

34. A cutting element according to claim 31, wherein the socket and insert extend through substantially the whole thickness of the cutting element.

35. A cutting element according to claim 31, wherein the upstanding part of the insert is domed.

36. A cutting element according to claim 35, wherein the outer periphery of the domed part of the insert lies at the same level as the front surface of the facing table.

37. A cutting element according to claim 31, wherein the upstanding part of the insert has a front surface which is inclined away from the front surface of the facing table as it extends away from the cutting edge.

38. A cutting element according to claim 37, wherein the edge of said inclined surface nearest the cutting edge of the facing table lies at the same level as the front surface of the facing table.

39. A cutting element according to claim 31, wherein the insert comprises a front layer of superhard material bonded to a substrate of less hard material, the superhard material forming a front surface on the upstanding part of the insert.

* * * * *